US006742280B1

(12) United States Patent
Andrén et al.

(10) Patent No.: US 6,742,280 B1
(45) Date of Patent: Jun. 1, 2004

(54) METHOD IN DRYING OF PAPER

(75) Inventors: Anders Andrén, Örsundsbro (SE); Stefan Backa, Västerås (SE); Johan Ekh, Västerås (SE); Xiaolong Feng, Västerås (SE); Thomas Liljenberg, Västerås (SE); Ulf Persson, Örsundsbro (SE); Xiaojing Zhang, Västerås (SE)

(73) Assignee: Andritz Technology and Asset Management GMBH, Graz (AT)

( * ) Notice: Subject to any disclaimer, the term of this patent is extended or adjusted under 35 U.S.C. 154(b) by 0 days.

(21) Appl. No.: 10/129,842

(22) PCT Filed: Nov. 9, 2000

(86) PCT No.: PCT/SE00/02189

§ 371 (c)(1),
(2), (4) Date: Sep. 13, 2002

(87) PCT Pub. No.: WO01/36745

PCT Pub. Date: May 25, 2001

(30) Foreign Application Priority Data

Nov. 18, 1999 (SE) ..... 9904158

(51) Int. Cl.[7] ..... F26B 3/00
(52) U.S. Cl. ..... 34/358; 34/443; 34/448
(58) Field of Search ..... 34/358, 413, 414, 34/443, 444, 445, 446, 448, 461, 463, 355

(56) References Cited

U.S. PATENT DOCUMENTS

| | | | | |
|---|---|---|---|---|
| 2,590,849 A | | 4/1952 | Dungler | |
| 3,791,044 A | * | 2/1974 | Busket et al. | 34/9 |
| 4,483,745 A | * | 11/1984 | Wicks et al. | 162/205 |
| 4,945,654 A | * | 8/1990 | Mason | 34/23 |
| 5,210,958 A | | 5/1993 | Bond et al. | |
| 5,298,124 A | * | 3/1994 | Eklund et al. | 162/306 |
| 6,004,430 A | * | 12/1999 | Ilvespaa et al. | 162/207 |

FOREIGN PATENT DOCUMENTS

| | | |
|---|---|---|
| DE | 30 03 718 | 8/1981 |
| GB | 2 065 852 | 7/1981 |

* cited by examiner

*Primary Examiner*—Henry Bennett
*Assistant Examiner*—Camtu Nguyen
(74) *Attorney, Agent, or Firm*—Burns, Doane, Swecker & Mathis, L.L.P.

(57) ABSTRACT

A method in consolidation and drying of paper. A wet web is contacted with superheated steam, whose temperature is 200–600° C. for the purpose of reducing, by heat transfer from the superheated stream, the water content of the web by evaporation of a substantial part of the water in the same. The wet web is supported and transported by means of a heat-conductive, gas-impermeable belt whose width is equal to or exceeds the width of the web, and jets of the superheated steam are directed towards the side of the web facing away from the belt.

35 Claims, 2 Drawing Sheets

METHOD IN DRYING OF PAPER

FIELD OF THE INVENTION

The present invention relates to a method in consolidation and drying of paper. A wet web is contacted with superheated steam for the purpose of reducing, by heat transfer from the superheated steam, the water content of the web by evaporation of a substantial part of the water.

BACKGROUND ART

Drying of a web-shaped material, such as paper, usually occurs by the wet web being contacted with hot surfaces or by blowing a hot gas, preferably air, towards the web.

In cylinder drying machines, the web-shaped material is heated by heated cylinders against which the web-shaped material is pressed by the web tension or by means of a felt or wire. The cylinders are heated by steam being supplied to their interior and condensing when contacting the casing of the cylinders. The condensate is evacuated continuously.

Water is preferably drawn off in free ventilated draws between the cylinders. The ventilation air, or at least the major thereof, is drawn off from the casing which encloses the cylinder drying machine. The amount of ventilation air drawn off is adjusted so that the moisture content of the exhaust air is adjusted towards a desired value, which is as high as possible in consideration of the risk of condensation etc.

Drying of so-called soft tissue occurs also on a single heated cylinder, a so-called yankee drier, in which drying occurs in combination with impingement of hot air or combustion gases.

Drying of paper also occurs completely without contact with a heat-emitting surface in drying machines with a so-called airborne web. In these drying machines, the web floats in a fixed position above or between blow boxes. The air leaving the blow boxes serves to carry the web, heat it and remove evaporated water.

The drying method affects to a very high degree the quality of the paper produced. The quality is also affected by a plurality of other parameters, such as how quick the paper is dried and in which temperature range it is treated.

Another method was already suggested in 1952 by Julian Dungler in U.S. Pat. No. 2,590,849. This method discloses a method for drying of cloth, paper and similar fibrous materials. Instead of using hot air or some other hot gas in drying, jets of superheated steam are directed at high speed towards the goods to be dried.

In conventional drying it is not possible to increase the temperature of the goods to be dried above the wet temperature as long as "free water" exists. By blowing steam, a bulk temperature corresponding to the current boiling point can be achieved very quickly during simultaneous condensation of part of supplied steam.

At the beginning of a paper drying process, where air at atmospheric pressure is used, a web has a temperature of only 50–60° C. whereas, when blowing superheated steam, in steam atmosphere, the web quickly reaches a temperature between 90 and 100° C. In addition to a reduction of the space required, this may result in an increased paper quality by the fibres being softer and being more strongly bonded to each other.

The advantages of steam drying appear to be so obvious that it is strange that this method did not gain a considerable market share, but since this has not occurred, there must have been decisive difficulties, so that the advantages did not outweigh these additional problems.

OBJECTS OF THE INVENTION

A main object of the present invention is to provide a simple and space-saving method for drying of paper.

A second object of the present invention is to provide a method of drying paper in an oxidation-free atmosphere.

A third object of the present invention is to provide a method for fixed drying of paper.

A fourth object of the present invention is to provide a method for drying of paper with superheated steam instead of e.g. air, in which expected quality gains can be achieved without increased costs of installation and operation.

SUMMARY OF THE INVENTION

The present invention relates to a method in consolidation and drying of paper. A wet web is contacted with superheated steam, whose temperature is 200–600° C., for the purpose of reducing, by heat transfer from the super-heated steam, the water content of the web by evaporation of a substantial part of the water in the same.

In the suggested method, the wet web is supported and transported with a heat-conductive, gas-impermeable belt whose width is equal to or exceeds the width of the web and jets of the superheated steam are directed towards the side of the web facing away from the belt.

GENERAL DESCRIPTION OF THE INVENTION

Properties and quality of a dried web are largely determined by the way of drying it. In addition to the technical conditions that must be taken into consideration, it must also be possible to produce the product economically to allow it to be sold in large volumes on a competitive market.

According to the present invention, a wet paper web is consolidated and dried in an oxidation-free atmosphere by contacting the web with superheated steam, whose temperature is 200–600° C. The wet web is supported and transported with a heat-conductive, gas-impermeable belt whose width is equal to or exceeds the width of the web and jets of the superheated steam are directed towards the side of the web facing away from the belt. By heat-conductive belt is here and henceforth meant a belt whose thermal conductivity is so good as to function as a temperature-equalising factor in the contact with the web. The belt is conveniently made of metal, such as stainless steel, but polymers are not excluded. By jets is meant flows with high speed and of essentially arbitrary cross-section, such as circular and elongate.

The method according to the invention aims at providing quicker drying than conventional methods, but all the same affording reasonable time, essentially exceeding the time in, for example, the nip of the impulse drying, for consolidation of the web. Superheated steam is blown towards the web for a period of, for example, 0.5–5 s.

A wire may be arranged between the belt and the web, but preferably the web is in direct contact with the belt. The belt can also be prepared for varying adhesion, and in case of increased adhesion shrinkage in the transverse direction can be prevented.

The drying can occur in a single step by steam of the same temperature being supplied during the entire drying procedure, but it is in many cases advantageous to divide the drying into two or more steps. Then the temperature of the steam in a first step is suitably higher than in one or more subsequent steps.

In two-step drying, for instance the temperature of the steam in the first stage is selected to be between 400 and 600° C., preferably between 480 and 540° C., and in a second step, for example, a temperature between 300 and 400° C. is selected, preferably between 330 and 370° C. The speed of impingement should be above 50 m/s, preferably between 80 and 120 m/s in the first step and between 60 and 120 m/s in the second step.

Advantageously the web is preheated to 90–100° C. before drying. This can conveniently take place by direct or indirect contact with essentially saturated water vapour. The preheating can be preceded by a treatment which serves to remove the air which is entrained in the wet web. The steam for preheating is suitably taken from the drying machine as evacuated steam from one of the drying steps, in the first place the second step or a later step in a multistage drying machine. The evacuated steam from the first drying step can also advantageously be used for supply to the second step or to a later step etc.

After preheating, the web can advantageously be mechanically dewatered to reduce the water content and simultaneously any remaining air can be evacuated. By this occurring at an increased temperature, the pressing will be more efficient and less water need be evaporated during drying. In this manner, it is also possible to render the wet pressing at the end of the wet end more efficient and thus reduce the investment cost by excluding one or more pairs of rolls. Analogously, it is advantageously possible to incorporate glazing in the drying machine where the web is already surrounded by hot water vapour.

According to a variant of the invention, the drying machine can besides be used as a chemical reactor by chemicals which affect the properties of the paper being supplied together with the vapour or in some other suitable manner in the preheating step and/or in one or more drying steps.

BRIEF DESCRIPTION OF THE DRAWINGS

The invention will now be described in more detail with reference to the accompanying drawings in which.

DESCRIPTION OF A SUGGESTED EMBODIMENT

Figure 1:
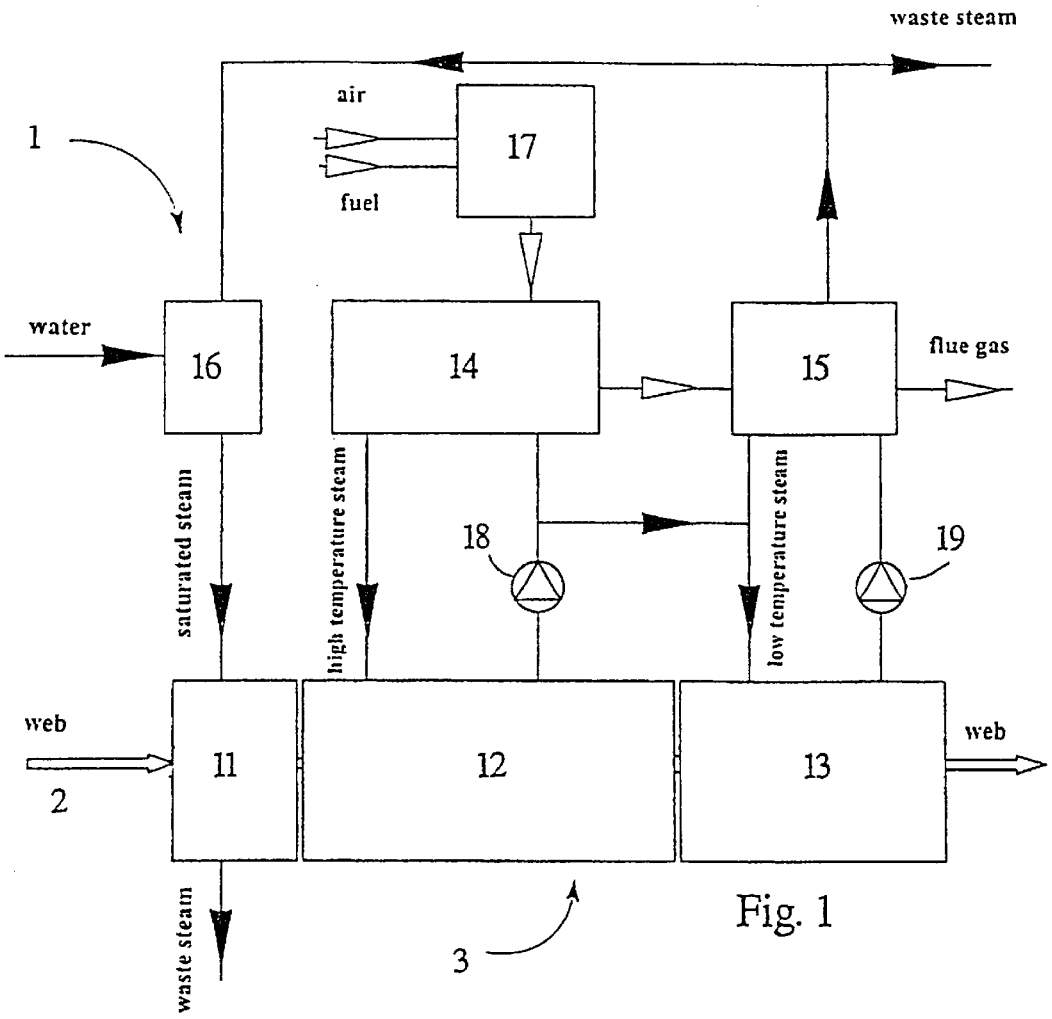
FIG. 1 is a flow chart of an embodiment of the invention.

FIG. 1 illustrates in the form of a flow chart a paper drying machine 1 where a web 2 passes through a treatment device 3 consisting of a preheating step 11 and two drying steps 12, 13. In a combustion chamber 17 hot flue gases are generated which are conducted to a high temperature heat exchanger 14 and after that to a low temperature heat exchanger 15. In the high temperature heat exchanger 14, high temperature steam is generated which is supplied to the first drying step 12. In the low temperature heat exchanger 15, low temperature steam is generated which is supplied to the second drying step 13. Surplus steam from the first drying step 12 is conducted to the second drying step 13. The surplus steam from the second drying step 13 is conducted partly via a device 16 for saturation with water to the preheating step 11 while the surplus steam from the second drying step 13, like the steam evacuated from the preheating step 11, is removed as waste steam to be used for other purposes. Steam is recirculated in each drying step 12, 13 by means of two fans 18, 19.

Figure 2:
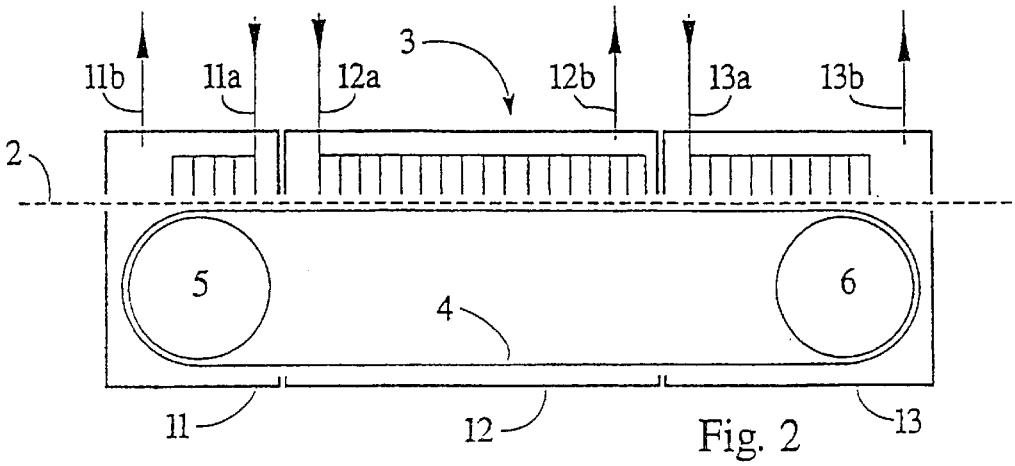
FIG. 2 illustrates a first embodiment of a paper drying machine according to the invention.

FIG. 2 is a schematic view of a first embodiment according to the invention of a treatment device 3 consisting of one preheating step 11 and two drying steps 12, 13. A web 2 is transported through all steps by means of a belt 4 of stainless steel running over two turning rolls 5 and 6. The preheating step 11 is provided with a nozzle system 11*a* for blowing saturated water vapour towards the web 2. Similarly, the two drying steps are provided with nozzle systems 12*a* and 13*a* for blowing superheated water vapour towards the web 2. The nozzle systems are, for the sake of clarity, drawn as tubing systems or the like. It goes without saying that they can be designed in many other ways, for instance as blow boxes or gaps. Used water vapour together with the steam that is being evaporated during drying is evacuated through conduits 11*b*, 12*b* and 13*b*.

Figure 3:
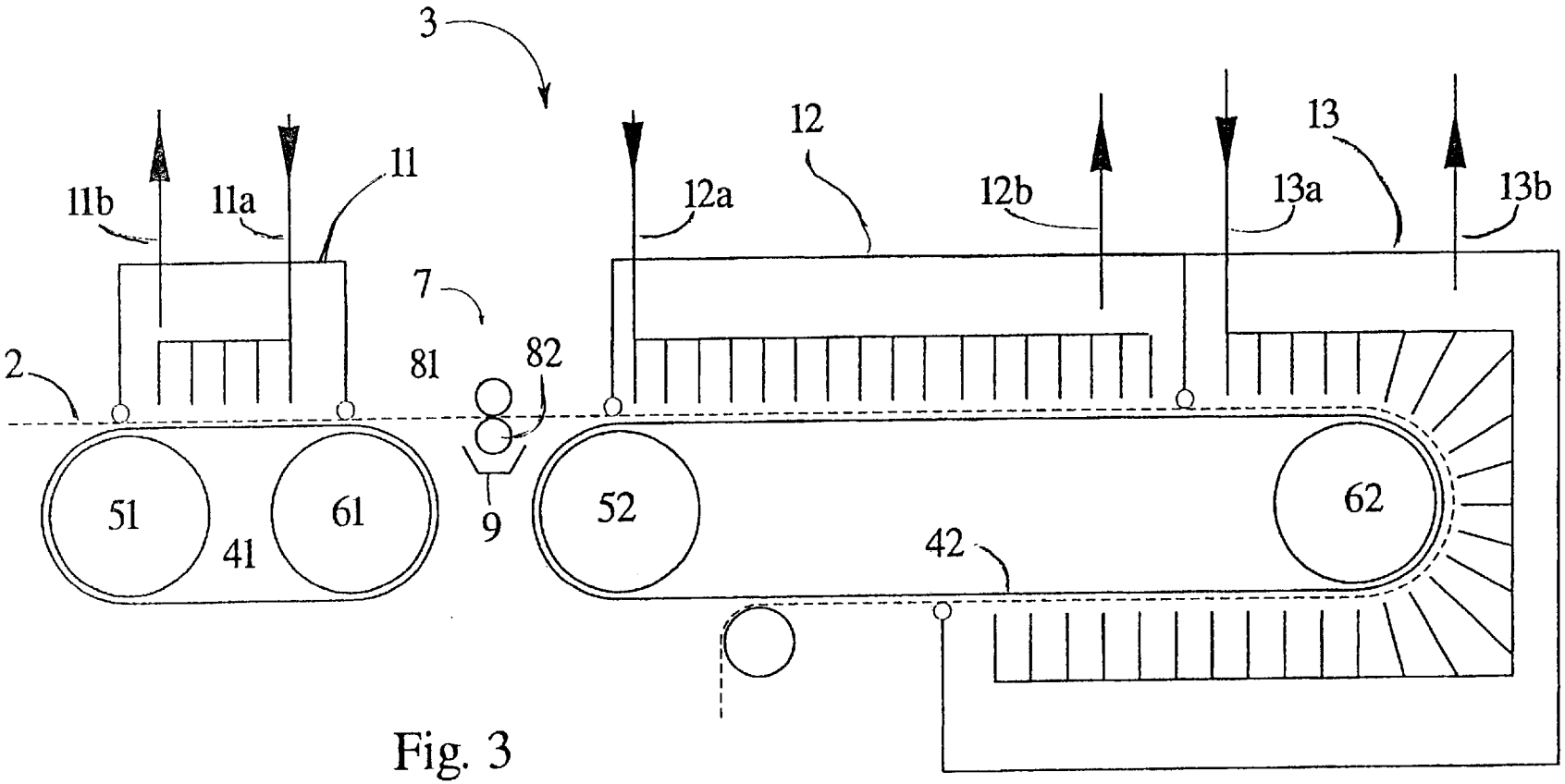
FIG. 3 illustrates a second embodiment of a paper drying machine according to the invention.

FIG. 3 is a schematic view of a second embodiment according to the invention of a treatment device 3 consisting of one preheating step 11 and two drying steps 12, 13. A web 2 is transported through the preheating step 11 by means of a first belt 41 of stainless steel running over two turning rolls 51 and 61. The web 2 is transported through the two drying steps 13 by means of a second belt 42 of stainless steel which runs over two turning rolls 52 and 62. Between the preheating step 11 and the drying step 12 there is a device 7 for mechanical dewatering, with two rolls 81 and 82 and subjacent means 9 for collecting press water. Steam is supplied and evacuated in the same way as in the embodiment according to FIG. 2.

In an exemplified embodiment of the invention, as described with reference to FIGS. 1 and 2, 25 t of paper an hour is dried in the treatment device 3, the pulp being based on completely dry substance. The dry content of the entering web 2 is 50%. In the preheating step 11 steam having a temperature of 103° C., 6.5 t/h, is supplied, and the web 2 is heated to 95° C. with a dry content of about 40% during condensation of the major part of the steam.

In the first drying step 12, steam having a temperature of 510° C. and a speed of 100 m/s, about 220 t/h, is made to impinge. 21 t of water an hour, at a temperature of 385° C., leaves the paper web 2, and this quantity is supplied to the next drying step 13 while the remainder is recirculated in the first drying step 12. The recirculating flow is heated in the high temperature heat exchanger 14 to 510° C. The dry content of the web 2 increases in the first drying step 12 to about 71%.

In the second drying step 13, steam having a temperature of 350° C. and a speed of 100 m/s, about 290 t/h, is made to impinge. 7 t of water an hour at a temperature of 320° C. leaves the web 2, and this quantity is removed together with the amount evacuated in the first drying step 12, 21 t/h, while the remainder is recirculated in the second drying step 13. The recirculating flow is heated in the low temperature heat exchanger 15 to 350° C. The dry content of the web 2 increases in the second drying step 13 to about 90%.

The steam evacuated from the second drying step 13 is divided into a flow which is saturated with water, in the device 16 intended therefor, and a flow of waste steam for use, for example, in heating of the building or in other process steps. The saturated water vapour is used in the preheating step 11 and the excess steam is removed therefrom.

The heat required for the recirculation flows through the high temperature heat exchanger 14 and the low temperature heat exchanger 15 is generated by combustion of oil in the combustion chamber 17. The hot flue gas from the combustion chamber 17 is conducted through the high temperature heat exchanger 14 as well as the low temperature heat exchanger 15 in this order and then to combustion air preheaters and gas cleaning systems (not shown).

ALTERNATIVE EMBODIMENTS

The invention is, of course, not restricted to the examples above and can be varied in many ways within the scope of the appended claims.

For instance, a paper drying machine according to the suggested embodiment can be combined with conventional drying with an airborne web or impingement of hot air. This occurs conveniently in such manner that the final drying takes place in a previously known manner while the first part of the drying is carried out according to the present invention. The first part of the drying can then result in the web being subjected to superheated steam for 0.5–2 s and leaving this drying step with a dry content of about 70%.

What is claimed is:

1. A method in consolidation and drying of paper, a wet web being contacted with superheated steam, at the temperature of 200–600° C., for the purpose of reducing, by heat transfer from the superheated steam, the water content of the web by evaporating a substantial part of the water in the same, comprising supporting and transporting the wet web by means of a heat-conductive, gas-impermeable belt whose width is equal to or exceeds the width of the web, and directing jets of the superheated steam towards the side of the web facing away from the belt;

wherein the drying occurs in at least two steps with different temperature of the superheated steam.

2. A method as claimed in claim 1, wherein the web is in direct contact with the belt.

3. A method as claimed in claim 1, comprising supplying, in the second drying step or a later drying step, at least part of the steam evacuated from the first drying step.

4. A method as claimed in claim 1, wherein the drying is preceded by a preheating step in which the web is contacted with, or heated indirectly with, essentially saturated water vapour.

5. A method as claimed in claim 4, wherein the web is contacted with the heat-conductive, gas impermeable belt before the preheating step and is kept in contact with said belt through at least one drying step.

6. A method as claimed in claim 4, wherein the web is contacted with a heat-conductive, gas impermeable belt before the preheating step and is kept in contact with said belt through all drying steps.

7. A method as claimed in claim 4, wherein the web is preheated to a temperature between 90 and 100° C.

8. A method as claimed in claim 4, comprising draining the web mechanically after the preheating.

9. A method as claimed in claim 1, comprising blowing, in a first drying step, steam having a temperature between 400 and 600° C. and a speed exceeding 50 m/s, preferably having a temperature between 480 and 540° C. and a speed between 80 and 120 m/s.

10. A method as claimed in claim 1, comprising blowing, in a second drying step, steam having a temperature between 300 and 400° C. and a speed exceeding 50 m/s, preferably having a temperature between 330 and 370° C. and a speed between 60 and 120 m/s.

11. A method as claimed in claim 3, comprising supplying, in the preheating step, at least part of the steam evacuated from a drying step, preferably from the second drying step or a later drying step.

12. A method as claimed in claim 4, comprising supplying, in the preheating step, at least part of the steam evacuated from a drying step, from at least one of the second drying step or a later drying step.

13. A method as claimed in claim 1, comprising adding chemicals in at least one of the drying steps and/or the preheating step.

14. A method as claimed in claim 1, comprising glazing the paper in one of the drying steps according to the invention.

15. A method as claimed in claim 2, wherein the drying is preceded by a preheating step in which the web is contacted with, or heated indirectly with, essentially saturated water vapour.

16. A method as claimed in claim 10, comprising supplying, in the preheating step, at least part of the steam evacuated from a drying step, preferably from the second drying step or a later drying step.

17. A method as claimed in claim 5, comprising draining the web mechanically after the preheating.

18. A method as claimed in claim 6, comprising draining the web mechanically after the preheating.

19. A method as claimed in claim 7, comprising draining the web mechanically after the preheating.

20. A method as claimed in claim 4, comprising blowing, in a first drying step, steam having a temperature between 400 and 600° C. and a speed exceeding 50 m/s, preferably having a temperature between 480 and 540° C. and a speed between 80 and 120 m/s.

21. A method as claimed in claim 5, comprising blowing, in a first drying step, steam having a temperature between 400 and 600° C. and a speed exceeding 50 m/s, preferably having a temperature between 480 and 540° C. and a speed between 80 and 120 m/s.

22. A method as claimed in claim 6, comprising blowing, in a first drying step, steam having a temperature between 400 and 600° C. and a speed exceeding 50 m/s, preferably having a temperature between 480 and 540° C. and a speed between 80 and 120 m/s.

23. A method as claimed in claim 7, comprising blowing, in a first drying step, steam having a temperature between 400 and 600° C. and a speed exceeding 50 m/s, preferably having a temperature between 480 and 540° C. and a speed between 80 and 120 m/s.

24. A method as claimed in claim 8, comprising blowing, in a first drying step, steam having a temperature between 400 and 600° C. and a speed exceeding 50 m/s, preferably having a temperature between 480 and 540° C. and a speed between 80 and 120 m/s.

25. A method as claimed in claim 4, comprising blowing, in a second drying step, steam having a temperature between 300 and 400° C. and a speed exceeding 50 m/s, preferably having a temperature between 330 and 370° C. and a speed between 60 and 120 m/s.

26. A method as claimed in claim 5, comprising blowing, in a second drying step, steam having a temperature between 300 and 400° C. and a speed exceeding 50 m/s, preferably having a temperature between 330 and 370° C. and a speed between 60 and 120 m/s.

27. A method as claimed in claim 6, comprising blowing, in a second drying step, steam having a temperature between 300 and 400° C. and a speed exceeding 50 m/s, preferably having a temperature between 330 and 370° C. and a speed between 60 and 120 m/s.

28. A method as claimed in claim 7, comprising blowing, in a second drying step, steam having a temperature between 300 and 400° C. and a speed exceeding 50 m/s, preferably having a temperature between 330 and 370° C. and a speed between 60 and 120 m/s.

29. A method as claimed in claim 8, comprising blowing, in a second drying step, steam having a temperature between 300 and 400° C. and a speed exceeding 50 m/s, preferably having a temperature between 330 and 370° C. and a speed between 60 and 120 m/s.

30. A method as claimed in claim 9, comprising blowing, in a second drying step, steam having a temperature between 300 and 400° C. and a speed exceeding 50 m/s, preferably having a temperature between 330 and 370° C. and a speed between 60 and 120 m/s.

31. A method as claimed in claim 9, comprising supplying, in the second drying step or a later drying step, at least part of the steam evacuated from the first drying step.

32. A method as claimed in claim 10, comprising supplying, in the second drying step or a later drying step, at least part of the steam evacuated from the first drying step.

33. A method as claimed in claim 9, comprising supplying, in the preheating step, at least part of the steam evacuated from a drying step, preferably from the second drying step or a later drying step.

34. A method in consolidation and drying of paper, a wet web being contacted with superheated steam, at the temperature of 200–600° C., for the purpose of reducing, by heat transfer from the superheated steam, the water content of the web by evaporating a substantial part of the water in the same, comprising supporting and transporting the wet web by means of a heat-conductive, gas-impermeable belt whose width is equal to or exceeds the width of the web, and directing jets of the superheated steam towards the side of the web facing away from the belt, wherein the drying is preceded by a preheating step in which the web is contacted with, or heated indirectly with, essentially saturated water vapour, and wherein the web is preheated to a temperature between 90 and 100° C.

35. A method in consolidation and drying of paper, a wet web being contacted with superheated steam, at the temperature of 200–600° C., for the purpose of reducing, by heat transfer from the superheated steam, the water content of the web by evaporating a substantial part of the water in the same, comprising supporting and transporting the wet web by means of a heat-conductive, gas-impermeable belt whose width is equal to or exceeds the width of the web, directing jets of the superheated steam towards the side of the web facing away from the belt, and blowing, in a second drying step, steam having a temperature between 300 and 400° C. and a speed exceeding 50 m/s, preferably having a temperature between 330 and 370° C. and a speed between 60 and 120 m/s, wherein the drying is preceded by a preheating step in which the web is contacted with, or heated indirectly with, essentially saturated water vapour.

* * * * *